US007036529B2

(12) United States Patent
Berggren et al.

(10) Patent No.: US 7,036,529 B2
(45) Date of Patent: May 2, 2006

(54) ARRANGEMENT FOR MIXING A FIRST AND A SECOND GAS FLOW

(75) Inventors: Gustav Berggren, Stockholm (SE); Fredrik Jansson, Stockholm (SE); Fredrik Westin, Stockholm (SE); Hans-Erik Ångström, Huddinge (SE)

(73) Assignee: Varivent Innovations AB, (SE)

( * ) Notice: Subject to any disclaimer, the term of this patent is extended or adjusted under 35 U.S.C. 154(b) by 188 days.

(21) Appl. No.: 10/363,350

(22) PCT Filed: Aug. 30, 2001

(86) PCT No.: PCT/SE01/01839

§ 371 (c)(1),
(2), (4) Date: Jul. 7, 2003

(87) PCT Pub. No.: WO02/18773

PCT Pub. Date: Mar. 7, 2002

(65) Prior Publication Data

US 2004/0099257 A1 May 27, 2004

(30) Foreign Application Priority Data

Aug. 30, 2000 (SE) ..... 0003074

(51) Int. Cl.
*G05D 11/02* (2006.01)
*F02M 25/07* (2006.01)

(52) U.S. Cl. ..... 137/892; 123/568.17; 137/219

(58) Field of Classification Search ..... 137/891, 137/892 I, 219 X; 123/568.17 X, 568.18
See application file for complete search history.

(56) References Cited

U.S. PATENT DOCUMENTS

| | | | | |
|---|---|---|---|---|
| 2,240,119 | A * | 4/1941 | Montgomery et al. | 251/124 |
| 2,794,447 | A * | 6/1957 | Spitz | 261/50.1 |
| 3,529,619 | A * | 9/1970 | Drewry | 137/219 |
| 3,996,748 | A * | 12/1976 | Melchior | 60/614 |
| 4,331,173 | A * | 5/1982 | Culaud | 137/219 |
| 4,860,795 | A * | 8/1989 | Oten | 137/892 |
| 5,611,204 | A | 3/1997 | Radovanovic et al. | 123/574 |
| 6,029,691 | A * | 2/2000 | Tavor | 137/219 |

FOREIGN PATENT DOCUMENTS

| | | |
|---|---|---|
| EP | 1 020 632 | 1/2000 |
| SE | 512 727 | 5/2000 |

* cited by examiner

*Primary Examiner*—Stephen M. Hepperle
(74) *Attorney, Agent, or Firm*—St. Onge Steward Johnston & Reens LLC

(57) ABSTRACT

An arrangement for mixing a first and a second gas flow, for example, an inlet flow with a exhaust gas return flow in a diesel engine, comprising a line (16) for the first flow, an inlet (7) for the second flow in the line (16), in order to achieve the mixing; a streamlined body (8) arranged to be displaced in the longitudinal direction of the line (16) at the inlet (7) in order to achieve a variable venturi effect and in this way a variable suction effect and mixture of the mixed flow; and actuating means for displacing the body forwards and backwards in the line. In order to minimise the need for throttling and the accompanying pressure losses, the streamlined body (8) and the supply part (2) are designed to achieve maximal throttling in the line (16) close to the inlet (7), independently of the position of the body.

23 Claims, 4 Drawing Sheets

ARRANGEMENT FOR MIXING A FIRST AND A SECOND GAS FLOW

TECHNICAL FIELD

The present invention concerns an arrangement for mixing a first and a second gas flow, for example, an input flow and a exhaust gas return flow in a diesel engine, comprising a line for the first gas flow, an inlet in the line for the second gas flow in order to achieve mixing, a streamlined body that can be displaced in the longitudinal direction of the line at the inlet in order to achieve a variable venturi effect and in this way a variable suction effect and mixing of the mixed flow, and actuating means for displacing the body forwards and backwards in the line.

PRIOR ART

As a result of expected stricter legislation concerning the levels of nitrogen oxides (NOx) in exhaust gases from diesel engines, extensive development is currently being carried out at many locations to produce a system for the cleaning of exhaust gases and reduction of the NOx levels. Solutions that function well with respect to petrol engines and lighter diesel engines are available according to present technology.

The situation with respect to exhaust gas cleaning technology is much more complex where turbocharged diesel engines with heavy operating conditions are concerned. Furthermore, these engines have a different operating cycle with higher loads during certification. Several solutions have been suggested, including expensive catalysis processes including several subprocesses (for example, injection of water, addition of urea) that in addition involve disadvantages in the form of complex and space-demanding components. The EGR (exhaust gas recirculation) concept, which has long been applied for lighter diesel engines in passenger cars, has attracted interest since it not only has advantages from the point of view of expense but also is expected not least to offer safe functioning and simple and compact construction.

During the turbocharging of heavy diesel engines that takes place when in operation, the pressure of the exhaust gases in most cases lies under the inlet pressure, and exhaust gases can therefore not be recirculated without measures being taken for achieving a supply of exhaust gases, in the form of, for example, venturi solutions, exhaust throttles or inlet throttles. However, these solutions have up until now been associated with disadvantages in the form of, for example, a reduced engine power through high pressure losses, together with increased fuel consumption and smoke development.

By placing a venturi in the inlet flow, an advantageous difference in pressure between the exhaust and the inlet channel is achieved, and exhaust gases, which are removed upstream of the turbo, can be fed into the inlet pipe of the engine. A reduced NOx level is obtained as a result of the resulting lower combustion temperature.

U.S. Pat. No. 5,333,456 (Carter) discloses a flow valve in the shape of a coil that is placed upstream in the EGR supply flow. This control valve cannot be used in the inlet channels of turbocharged engines, not least as a result of its design.

U.S. Pat. No. 5,611,204 (Cummins) discloses a flow regulator with venturi function, placed, however, in the inlet channel next to the EGR supply flow. The opening for supply of exhaust gases is not located where the throttling of fresh air is greatest, which would involve a more severe throttling than necessary, while the total pressure losses, which arise from, for example, the neighbouring actuating means, become significant.

The publication SAE 2000 World Congress, SAE Technical Paper Series 2000-01-0225 discloses a variable venturi with axial EGR supply. The design does not display a proper venturi shape since the fresh air is exposed to a momentary increase in area at the end of the injector pipe, and the pressure losses that follow from this. The component must be equipped with an elbow, with its associated pressure losses, as a result of the axial supply, and furthermore, the fact that the dimensions of the component are unnecessarily bulky must also be considered. The arrangement is primarily intended for measurement purposes and has no interest with respect to normal operating conditions.

SUMMARY OF THE INVENTION

One object of the present invention is to provide an arrangement of the type specified in the introduction that minimises pressure losses when mixing the two gases.

This is achieved by the characteristics that are specified in the claims.

According to one aspect of the invention, the streamlined body and the supply part are designed to achieve maximal throttling in the line close to the inlet, independently of the position of the body. In other words, the momentary throttle effect of the first flow will then always be greatest in close proximity to the inlet independently of the displacement/location of the body in the direction of flow. The requirement for throttling, and thus the associated pressure losses, are in this way minimised.

A flow regulator for EGR systems in the form of a variable venturi has been developed on the basis of the present invention, intended for mounting in the inlet part of turbocharged diesel engines. The flow regulator comprises a pipe section with a radial EGR supply flow and an essentially freely suspended body in it. The body can be displaced in the direction of the flow and is preferably designed such that the instantaneous throttling of fresh air is always greatest in the immediate vicinity of the inlet for supply of exhaust gases, independently of the position of the body. Thus, it is included that the throttling varies optimally during the regulation as a consequence of the variation with respect to the flow area of fresh air between the body and the wall of the pipe during supply of exhaust gases. In this way, the varying requirement for pumping is satisfied, with a minimum of pressure losses.

With respect to variable venturi solutions according to the prior art, based on what can be extracted from available patent literature, the importance of maximising the throttling of fresh air at the opening for exhaust gas supply has not been realised, nor has the improved pump effect that is in this way achieved.

The venturi effect is principally achieved through the design of the streamlined body, and can in particular cases be supplemented with a fixed venturi part, the diameter of which is either greater than or less than the greatest diameter of the drop section. An outlet cone (diffuser) can be incorporated with the rear part of the pipe section, as necessary, which makes its mounting possible in inlet channels with varying dimensions.

The invention thus concerns in particular a flow regulator with location in the inlet channel of a turbocharged diesel engine with a construction in the form of a section of pipe with an element for radial supply of exhaust gases and a freely suspended body that can be axially displaced in the section via an actuating means in agreement with the present claim 1.

According to one preferred embodiment of the present invention, the body is controlled by an actuating means that is integrated with the body or that is arranged outside of the pipeline. The first flow is not disturbed by such an actuating means, nor are any pressure losses caused. Furthermore, such a design can be produced considerably robust, compact, and displaying minimal external dimensions. According to U.S. Pat. No. 5,611,204 (FIG. 9), pressure losses are caused by, among other effects, the formation of whirlpools at neighbouring actuating means and those fixed components used for reduction of the area of the transverse flow.

The properties of the body, its location in the inlet channel and the actuating means allow a minimal disturbance of the supply of air to be achieved, and very good regulation is achieved with thorough mixing of the air supply for varying loads on the engine.

BRIEF DESCRIPTION OF THE DRAWINGS

The attached drawings, partly in longitudinal section and with cut-away parts, show details as follows.

DESCRIPTION OF PREFERRED EMBODIMENTS

Figure 1:
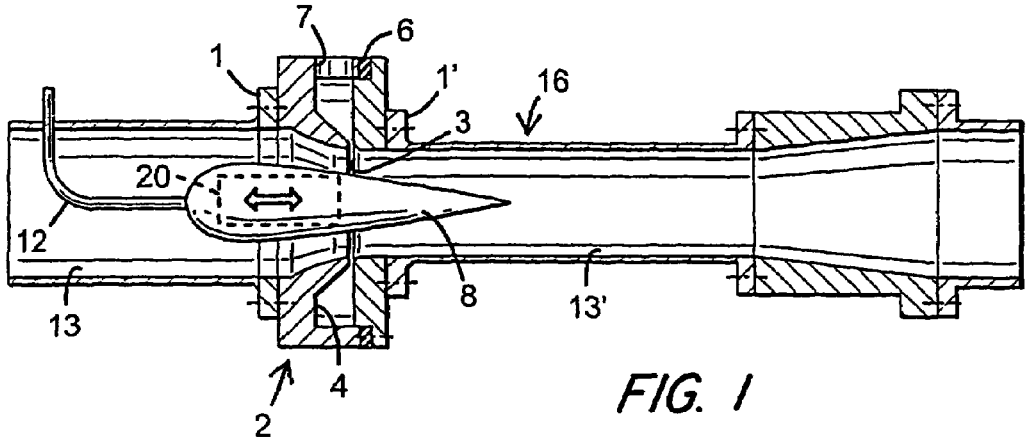
FIG. 1 shows the flow regulator with its associated outlet cone.

Embodiments of the invention will be described in the following text as preferred embodiments in association with exhaust gas recirculation of a turbocharged diesel engine. The invention, however, is not limited to this, but can be used in many different applications where two gas flows are to be mixed. One example is oxygen-enrichment, that is, supply of oxygen to another gas. The area of application can in this case be, for example, refuse combustion plants.

In the preferred application, an EGR supply flow is introduced radially via a supply part 2 in an inlet channel or pipeline generally denoted by 16 from a turbocharger that is not shown. The supply part 2 is inserted between flanges 1, 1' of a pair of pipe sections 13 and 13' in the line 16. The supply part 2 forms a flow regulator together with the streamlined body 8 described below. On the basis of the designs of the streamlined body 8 and the supply part 2, the greatest throttling of fresh air is always achieved at the gap 3 for exhaust gas introduction, independently of the position of the body 8. In the embodiment shown, the supply part 2 is designed with a cross-sectional area that decreases up to the slit in the direction of flow in the line 16 for this purpose. This reduction in the cross-sectional area of the supply part 2 is, furthermore, greater than the reduction in the cross-sectional area of the streamlined body 8 downstream of its greatest cross-sectional area in the direction of flow in the line 16. In the active diffuser region downstream of the slit 3, the pipeline 16 has, in the embodiment shown, a constant cross-sectional area, while the cross-sectional area of the streamlined body 8 continues to decrease in this region. The actuating means 20 is arranged such that the greatest cross-sectional area of the streamlined body 8 is never displaced downstream of the slit 3. The ring-shaped channel that is limited between the supply part 2 and the streamlined body 8 thus always has a convergent course in the direction of flow up to the slit 3 and a divergent course after the slit 3 independently of the position of the body 8.

Supply flow preferably occurs via a continuous circular slit 3 through the supply part 2, which in this case is in two parts, but it can also be achieved via a number of holes or slits around the perimeter (not shown).

Even if the supply occurs radially, the direction of the supply at the inlet 7 of the supply part 2 can be selected to lie at such an angle that the desired flow conditions and the least possible flow losses can be achieved when mixing the two gases.

By maximising the throttling of fresh air at the inlet of exhaust gases 3 according to the invention, the greatest possible pump effect is also achieved, that is, the solution involves very small pressure losses. As a consequence of the free flow of air around the present streamlined body 8, which displays a venturi effect in itself, deterioration of the power of the engine is avoided in the same way while good regulation of the EGR supply is achieved.

Figure 6A:
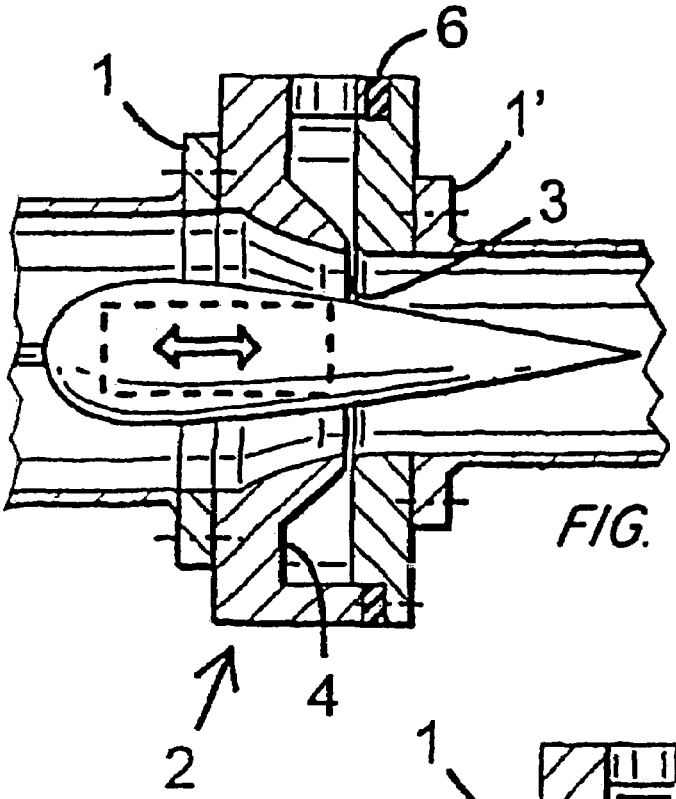
FIGS. 6A and 6B show in more detail portions of the flow regulator of FIG. 1 illustrating the variability of a desired gap distance.
Figure 6B:
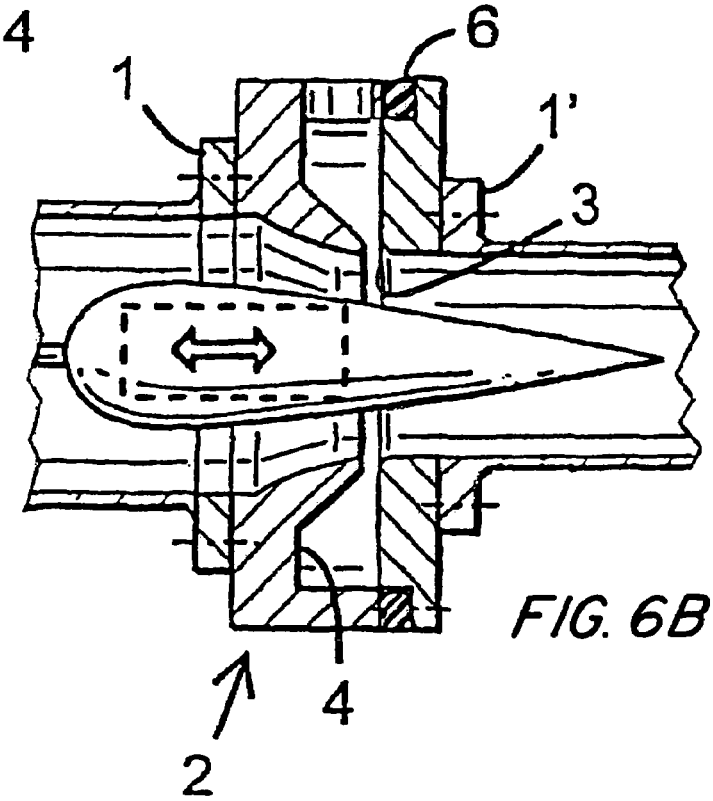

A continuous, cylindrical cavity 4 exists around the gap 3. A gasket 6 is placed between the two parts of the supply part. The desired gap distance in the opening 3 can be achieved by selecting the thickness of the gasket 6 (as illustrated in FIGS. 6A and 6B). A supply pipe for the EGR supply flow can be mounted in a manner that is not shown at the inlet 7 of the supply part 2 from an extension of a manifold for the exit exhaust gases of the engine.

The input air is cooled in the conventional manner downstream of the turbocharger by an intercooler that is not shown, and the EGR gases are cooled in the same way via a separate EGR cooler before supply into the inlet channel. The flow regulator can be placed at a freely chosen location downstream of the turbocharger. However, the flow regulator is preferably located downstream of the intercooler to prevent the latter being contaminated with soot or being corroded by the acidic exhaust gases.

The streamlined body 8 is freely suspended within the supply part 2 by means of a holder 12 that extends from the front edge of the body 8 and outwards into the pipe section 16. The actuating means 20 for displacement of the body 8 forwards and backwards relative to the supply part 2 can, according to the invention, be arranged either within the body 8 or outside of the line 16.

Figure 2:
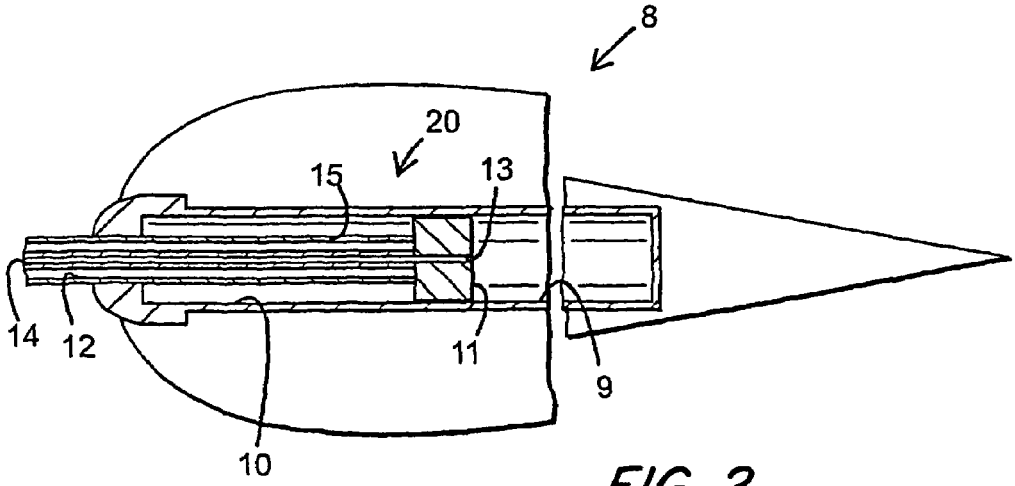
FIG. 2 shows the streamlined body with its integrated fluid-controlled actuating means.

In the embodiment according to FIGS. 1 and 2, the holder 12 is attached to the outer wall of the pipe section 13 and comprises a feed pipe 12 for regulation of the actuating means 20. The actuating means 20 can be regulated by hydraulic means or through a gaseous fluid, preferably pressurised air that is available on commercial vehicles through the braking system. The actuating means is integrated with the body 8, that is, it is located inside of it. At that, a cylinder 9 is placed inside the body, which cylinder 9 exits through a sealing to the feed pipe 12 of the forward portion of the part of the body 8 with greatest cross-sectional area or with least cross-sectional area, preferably the forward external surface of the part with greatest cross-sectional area. The feed pipe 12 contains an additional smaller feed pipe 14. A spring element, not shown, can be attached against the wall of the cylinder 9 that is placed furthest away from the feed pipe, which spring element influences a piston 11 placed at the end of the feed pipe 12. The piston in turn is equipped with a channel 13 opening at one free end of the piston 11. The perimeter hole 10, along the channel part, which can also contain a spring element, not shown, placed between the piston and the wall of the cylinder placed closest to the feed pipe 12, is equipped with an opening 15 into the feed pipe 12 at the second end of the piston. Thus the streamlined body 8 attached to the cylinder 9 can be displaced forwards and backwards relative to the gap 3 within the supply part 2 by variation of the fluid pressure in, on the one hand, the feed pipe 12 and, on the other hand, the smaller feed pipe 14.

A particularly simple and robust construction of the flow regulator is achieved by integrating the actuating means with the body, as has been shown by the above description.

Figure 3:
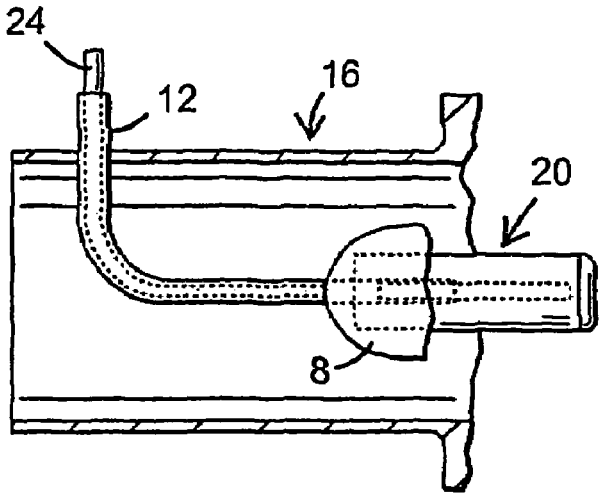
FIG. 3 shows a general design with integrated actuating means for the streamlined body.
Figure 4:
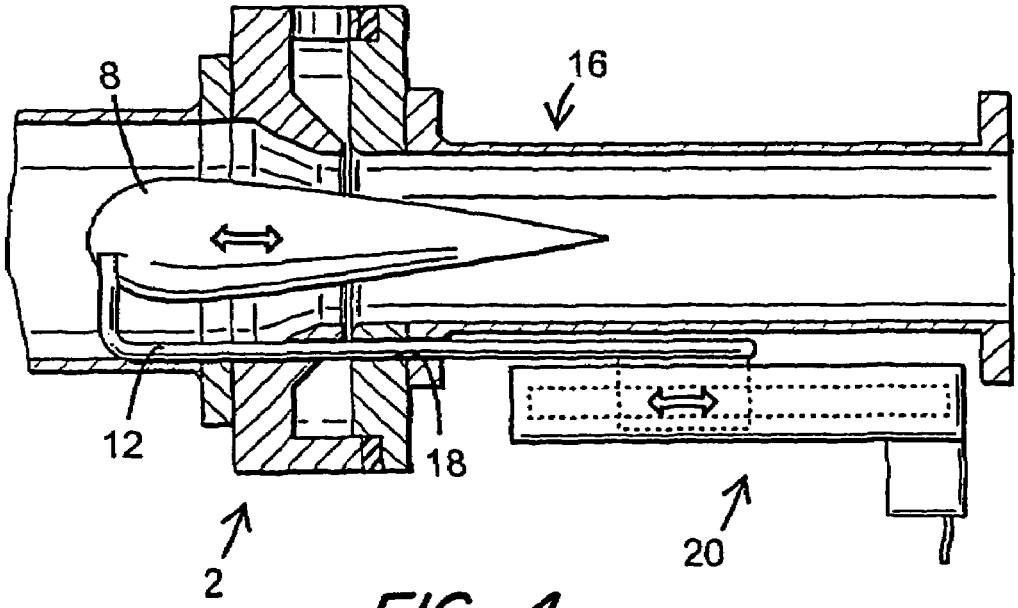
FIG. 4 shows the flow regulator with an external actuating means.

The actuating means 20 can, as is suggested in FIGS. 3, 4 and 5, be of a general type. The actuating means can be, in addition to hydraulic or pneumatic, electromechanical, with power supply through a cable 24 in the holder 12 (FIG. 3) and an electrical motor or solenoid built into the body. It can also be purely mechanical if, for example, the cable 24 is replaced by a Bowden cable that displaces the body 8 forwards and backwards along the axial section of the holder 12 via an external actuating means 20 against the force of a return spring (not shown) inside the body 8.

Figure 5A:
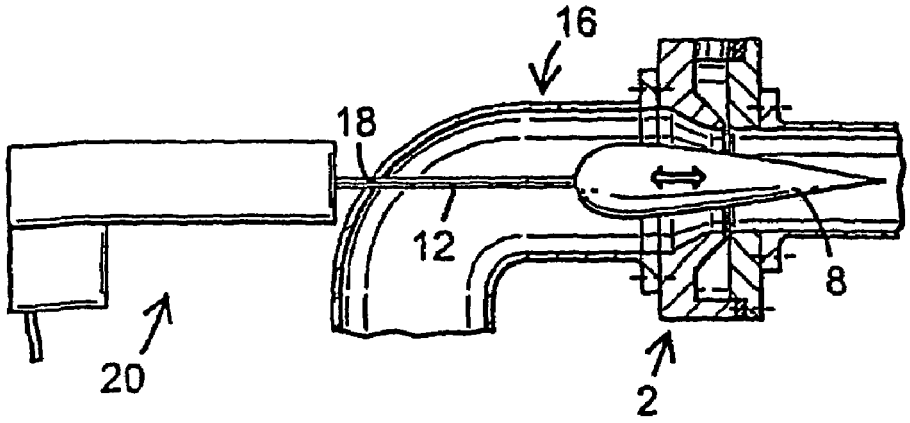
FIGS. 5A and 5B shows an alternative design with an external actuating device.
Figure 5B:
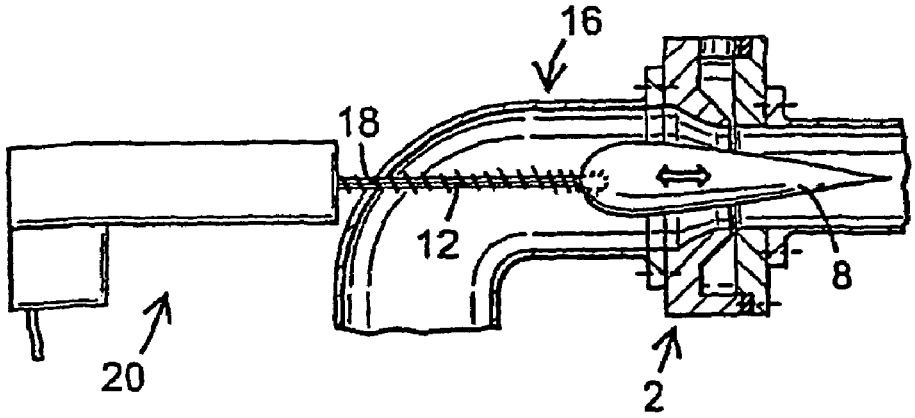

Two embodiments of the actuating means placed outside of the line 16 are shown in FIGS. 4 and 5. According to FIG. 4, the holder extends at an angle downstream through a bore 18 in the supply part 2. According to FIG. 5, the holder extends in a straight line through the bore 18, which in this case is located at a bend in the line 16. The holder 12 can be executed as a rod, mounted in bearings to slide in the bore 18 (as shown in FIG. 5A). The holder may also be threaded or executed as a ball screw, alternatively having the corresponding inner thread in body 8 or bore 18, whereby only rotating motion needs to be achieved outside of the pipe 16 (as shown in FIG. 5B).

That part of the holder 12 that extends across the flow in the line 16 can, as is suggested in FIG. 3, have an extended streamlined cross-section in order to minimise pressure losses in the line 16.

Thus lower pressure losses in the pipeline arising from the disturbing affects of, for example, an actuating means placed inside the channel are achieved, compared with earlier known designs, through the integrated actuating means or the actuating means placed outside of the pipeline according to the invention.

In contrast to earlier technology, using, among other things, valve-like venturi solutions in the form of a combination of a displaceable coil-formed body and a fixed venturi part, it has been possible to eliminate to a major extent pressure losses in the inlet air according to the present invention.

The invention claimed is:

1. An arrangement for mixing a first gas flow and a second gas flow comprising:

a line for the first flow;

a supply part having an inlet for the second flow in the line, in order to achieve the mixing;

a streamlined body arranged to be displaced in a longitudinal direction of the line at the inlet in order to achieve a variable venturi effect and in this way a variable suction effect and mixture of the mixed flow, the streamlined body penetrating a plane perpendicular to a longitudinal axis of the supply part at the inlet; and an actuator which displaces the body forwards and backwards in the line;

wherein the streamlined body and the supply part define a venturi therebetween, and wherein the supply part has a cross-sectional area that decreases in the direction of flow in the line up to the inlet, such that the venturi has a throat proximate to the inlet independently of the position of the streamlined body in order to achieve maximal throttling in the line in close proximity to the inlet independently of the position of the body, in order to minimize the need for throttling and accompanying pressure losses.

2. The arrangement according to claim 1, wherein the actuator is arranged inside of the body or outside of the line in order not to disturb the first flow and cause pressure losses therein.

3. The arrangement according to claim 1, wherein the inlet is arranged around a cross-section of the line in order to maximize the suction effect and in this way minimize pressure losses.

4. The arrangement according to claim 3, wherein the inlet is designed in the form of a gap.

5. The arrangement according to claim 4, wherein the gap has a gap width that can be adjusted, such that the area of flow can be optimized for various mixture conditions with the aim of minimizing pressure losses.

6. The arrangement according to claim 1, wherein the streamlined body is suspended at a front end thereof by means of a holder that extends to an external surface of the line.

7. The arrangement according to claim 6, wherein the holder has a streamlined cross-section in order to minimize pressure losses.

8. The arrangement according to claim 6, wherein the holder, when the actuator is arranged either inside the body or outside of the line, comprises an energy supply for supplying energy to the actuator.

9. The arrangement according to claim 7, wherein the holder, when the actuator is arranged outside of the line comprises a smooth rod arranged to slide on bearings in a holebore in an outer wall of the line, a threaded rod arranged to cooperate with a threaded hole in the outer wall of the line, or a ball screw.

10. The arrangement according to claim 1, wherein the first gas flow and the second gas flow comprise an inlet flow and an exhaust gas return flow in a diesel engine.

11. An arrangement for mixing a first gas flow and a second gas flow, said arrangement comprising:

a line for the first gas flow;

a supply part having an inlet in the line for the second gas flow, in order to achieve the mixing;

a streamlined body arranged to be displaced in a longitudinal direction of said line at the inlet in order to effect mixture of the first gas flow and a second gas flow, the streamlined body penetrating a plane perpendicular to a longitudinal axis of the supply part at the inlet; and an actuator which displaces said body forwards and backwards in said line, said actuator being located outside of the first gas flow in order not to disturb the first gas flow and cause pressure losses therein;

wherein the streamlined body and the supply part define a venturi therebetween, and wherein the supply part has a cross-sectional area that decreases in the direction of flow in the line up to the inlet, such that the venturi has a throat proximate to the inlet independently of the position of the streamlined body.

12. The arrangement of claim 11, wherein said actuator is located outside of said line.

13. The arrangement of claim 11, wherein said actuator is located within said body.

14. The arrangement of claim 11, wherein said body is configured so as to create a variable venturi effect and in this way a variable suction effect within said line.

15. The arrangement of claim 14 wherein said body and said supply part are designed to achieve maximal throttling in said line in close proximity to the inlet independently of the position of said body in order to minimize the need for throttling and accompanying pressure losses.

16. The arrangement of claim 15, wherein the inlet is arranged around a cross-section of said line in order to maximize the suction effect and in this way minimize pressure losses.

17. The arrangement of claim 16, wherein the inlet is designed in the form of a gap.

18. The arrangement of claim 17, wherein the gap has a gap width that can be adjusted, such that the area of flow can be optimized for various mixture conditions with the aim of minimizing pressure losses.

19. The arrangement of claim 11, wherein said body is suspended at a front end thereof by means of a holder that extends to an external surface of said line.

20. The arrangement of claim 19, wherein the holder has a streamlined cross-section in order to minimize pressure losses.

21. The arrangement of claim 19, wherein the holder comprises an energy supply for supplying energy to the actuator.

22. The arrangement of claim 19, wherein the holder comprises a smooth rod arranged to slide on bearings in a holebore in an outer wall of said line.

23. The arrangement of claim 11, wherein the first gas flow and the second gas flow comprise an inlet flow and an exhaust gas return flow in a diesel engine.

* * * * *